US008740319B1

(12) United States Patent
Davis et al.

(10) Patent No.: US 8,740,319 B1
(45) Date of Patent: Jun. 3, 2014

(54) RECESSED GANGING LOCK AND STORAGE CABINET THEREWITH

(75) Inventors: Justin Davis, Noblesville, IN (US); Adam Anderson, Indianapolis, IN (US); James J. Jannetides, Fishers, IN (US)

(73) Assignee: J Squared, Inc., Greenfield, IN (US)

( * ) Notice: Subject to any disclaimer, the term of this patent is extended or adjusted under 35 U.S.C. 154(b) by 108 days.

(21) Appl. No.: 13/092,029

(22) Filed: Apr. 21, 2011

Related U.S. Application Data

(60) Provisional application No. 61/326,494, filed on Apr. 21, 2010.

(51) Int. Cl.
*E05C 9/10* (2006.01)
*E05B 65/44* (2006.01)

(52) U.S. Cl.
USPC ..... 312/216; 70/78

(58) Field of Classification Search
USPC ..... 312/107.5, 215, 216, 217, 218, 219, 312/220, 221, 222; 70/78, 79, 80
See application file for complete search history.

(56) References Cited

U.S. PATENT DOCUMENTS

| | | | | | |
|---|---|---|---|---|---|
| 1,716,274 | A | * | 6/1929 | Jones | 312/217 |
| 1,829,770 | A | * | 11/1931 | Tannewitz | 312/221 |
| 2,967,080 | A | * | 1/1961 | Nelson | 312/216 |
| 2,987,358 | A | * | 6/1961 | Roberts | 312/216 |
| 3,002,800 | A | * | 10/1961 | McMahan | 312/216 |
| 3,189,392 | A | * | 6/1965 | Mehlig, Jr. et al. | 312/216 |
| 3,328,106 | A | | 6/1967 | Mullin | |
| 3,856,373 | A | * | 12/1974 | Tucich | 312/216 |
| 4,057,306 | A | | 11/1977 | Resch | |
| 4,288,134 | A | * | 9/1981 | Knaack et al. | 312/290 |
| 4,852,920 | A | | 8/1989 | DeForrest | |
| 4,929,861 | A | * | 5/1990 | Metcalf | 312/9.63 |
| 5,000,494 | A | | 3/1991 | Guibleo | |
| 5,076,078 | A | * | 12/1991 | Weger, Jr. | 70/54 |
| 5,282,669 | A | | 2/1994 | Barile | |
| D443,995 | S | | 6/2001 | Caruso et al. | |
| 6,685,288 | B1 | | 2/2004 | MacMillan | |
| 6,742,854 | B2 | * | 6/2004 | Chen | 312/217 |
| 2007/0271971 | A1 | * | 11/2007 | Johnson | 70/58 |
| 2010/0123375 | A1 | * | 5/2010 | Romaen et al. | 312/215 |

* cited by examiner

*Primary Examiner* — James O Hansen

(74) *Attorney, Agent, or Firm* — William F. Bahret

(57) ABSTRACT

A lockable cabinet comprising a case, a drawer, a ganging lock mechanism, and a lock box recessed into the case. The lock box contains an external lock for securing the cabinet through a hasp style locking structure. The ganging lock mechanism prevents drawers from slidably moving from the cabinet when in the locked position and allows the drawers to be slidably moved to an open position when in the unlocked position.

20 Claims, 10 Drawing Sheets

RECESSED GANGING LOCK AND STORAGE CABINET THEREWITH

CROSS-REFERENCE TO RELATED APPLICATION

This application claims the benefit of Provisional Patent Application No. 61/326,494, filed Apr. 21, 2010, which application is hereby incorporated by reference.

BACKGROUND OF THE INVENTION

This invention relates to locking mechanisms for furniture pieces, and more particularly to ganging locks for locking multiple drawers of a cabinet.

Many storage cabinets have lockable drawers or doors. For example, file cabinets are well-known for having lockable drawers that open forwardly to provide access to paper files and the like inside. Similarly, desks often have several drawers that can be locked. In some storage cabinets the individual compartments are individually lockable. For example, a desk may include an internal lock on each of several different drawers that are independently lockable using a key. In other storage cabinets, multiple compartments may be secured using a single locking mechanism. This type of locking mechanism is typically called a ganging lock or a gang lock. In particular, a ganging lock is a lock that is designed to lock multiple compartments through a single lock. For example, file cabinets and tool chests often include a ganging lock which uses a single lock to secure the multiple drawers of the cabinet. One example is U.S. Pat. No. 4,057,306 to Resch et al., which is hereby incorporated by reference in its entirety for disclosure related to internal gang locks. Resch et al. disclose a ganging lock mechanism for securing cabinet drawers.

As with many storage cabinets, Resch et al. discloses a storage cabinet having an internal lock structure. These furniture pieces are adapted to receive a key or combination which unlocks the internal locking device (e.g. tumbler, switch). Once unlocked, the drawer or drawers can be opened. One attribute of many internal lock structures is that they have been designed to avoid protrusion from the exterior of the cabinet. However, there are other disadvantages to internal locking devices generally which may make them undesirable for certain applications. For example, the lock and the furniture may be so fully integrated that replacement of the locking device is unsatisfactorily difficult. For example, replacement of the lock may require disassembly or retrofitting the furniture. Second, external locks are often considered more robust and can be exchanged with newer, more advanced designs as those locks become available. As such, the external locks may be selected to meet higher security standards. Furthermore, if the security of a lock is breached or the lock is broken, an external lock may be easily replaced with a new lock.

Another example of an internal lock structure is U.S. Pat. No. 3,893,740 to England et al., which is hereby incorporated by reference in its entirety for disclosure related to internal gang locks. England et al. disclose a locking structure that partially encloses the face of the drawers to impede their movement. While not internal within the cabinet, this structure is referred to as internal within the present disclosure because it is welded directly to the cabinet and replacing the lock would require substantial retrofitting. This type of internal lock is in contrast to a typical "hasp" style lock mechanism which uses a padlock.

A hasp can be attached to a cabinet on either a front or side panel and allow for the securing of the cabinet through use of an external lock. However, most of these hasp style locking mechanisms protrude from the cabinet. As the term is used herein, a hasp style lock uses an external lock (e.g., a padlock) in conjunction with two relatively movable portions of a hasp, e.g., a metal plate or strap and a staple or other member configured to receive a portion of a lock so as to secure the two hasp portions together. Because the hasp style lock can receive various different locks, a variety of padlocks can be used and intermittently changed as necessary. The typical protruding hasp or associated padlock can catch on clothes or the occasional shin of a passerby and cause damage or injury. Some storage cabinets use a recessed hasp style lock. For example, U.S. Pat. No. 5,000,494 to Guibleo, which is hereby incorporated by reference in its entirety, relates to a gymnasium locker door in which a hasp and padlock are located within a recessed portion of the door panel. U.S. Pat. No. 4,852,920 to DeForrest, which is hereby incorporated by reference in its entirety for disclosure related to self protecting hasps, describes a means of protecting external hasps and locks from damage and/or tampering.

While the known mechanisms may be suitable in their particular applications, each has advantages and disadvantages, and a need remains for improved ganging locks for storage cabinets.

SUMMARY OF THE INVENTION

The present invention provides a recessed lock that allows an associated padlock to be tucked away in a chest or other storage cabinet.

One aspect of the present invention involves a lockable cabinet comprising a case, a drawer movably connected to the case by a drawer slide, a lock box; and a locking mechanism. The locking mechanism may have a movable locking bar inside the case, a drawer stop mounted on the locking bar, a stationary hasp portion, and a movable hasp portion. The drawer stop is positioned to impede movement of the drawer when the locking mechanism is in a locked position. The movable and stationary hasp portions are positioned in the lock box so as to not protrude outside the perimeter of the case. The hasps are configured to jointly receive a lock when the locking mechanism is in the locked position and the movable hasp portion extends from the lock box into the case and operably connects to the locking bar.

Other aspects and advantages of the present invention will be apparent from the following descriptions with reference to the drawings.

DETAILED DESCRIPTION OF PREFERRED EMBODIMENTS

Figure 1:
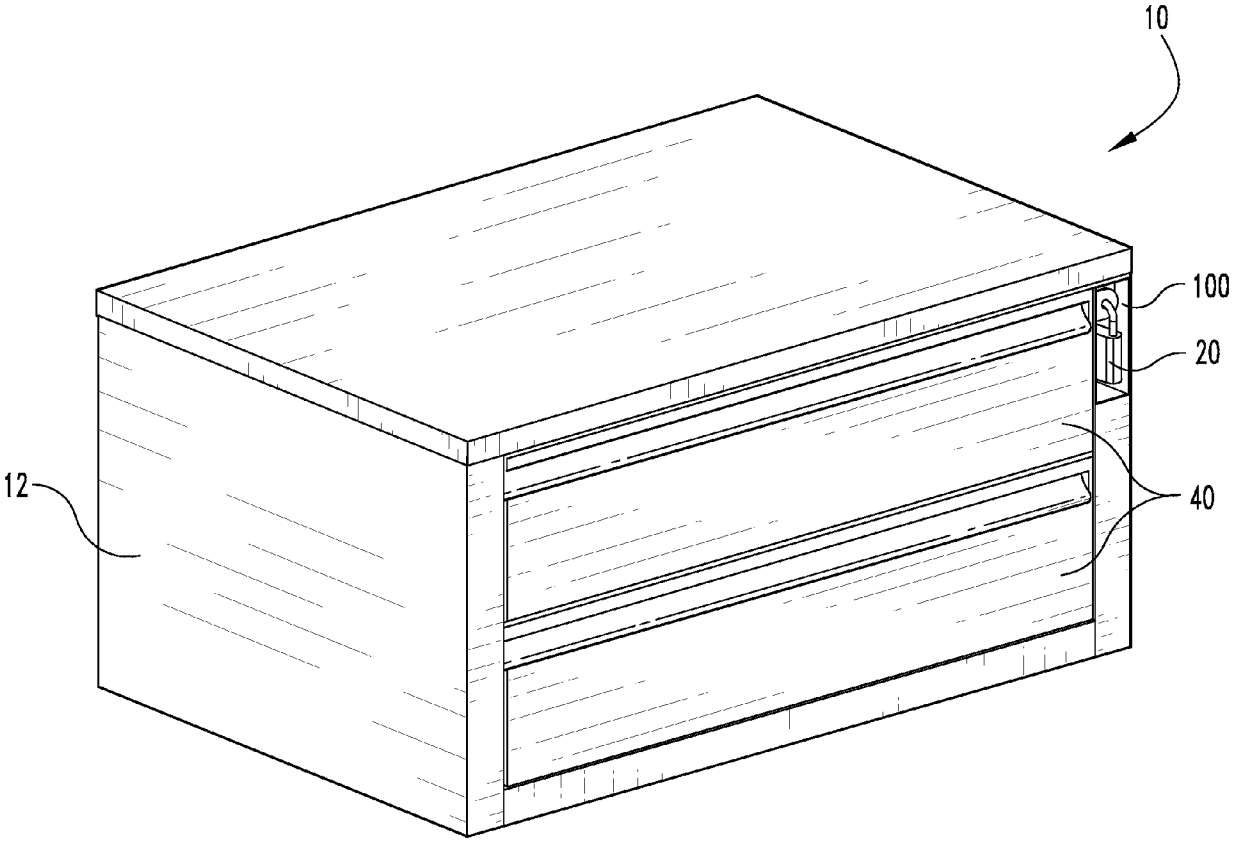
FIG. 1 is perspective view of an embodiment of a lockable cabinet according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Referring now to FIG. 1, shown is an embodiment of a lockable cabinet 10 according to the present invention. Lockable cabinet 10 is shown having two drawers 40 within a case 12. The case includes a lock box 100 recessed within the case so as to maintain a clean outer profile, free from protrusions, be they associated with a lock 20 or with a locking mechanism 30, shown in FIG. 2(A-B). As shown in FIG. 1, the front face of the lockable cabinet is completely devoid of protrusions. In particular, although the lockable cabinet is externally lockable, the hasps for attaching an external lock are in the lock box so as to not create a protrusion. While the lock box is referred to as a box, the actually shape of the recessed volume is not limited to rectangular in cross-section. Instead, different shape lock boxes are contemplated including those with curvature or those with numerous sides. The rectangular box shown is intended to exemplify a particularly simple shape for the lock box.

The lockable cabinet of FIG. 1 can be made of any suitable material. In illustrative embodiments, the case and/or drawers are made from metal. In one embodiment, the case and/or drawers are made from a combination of wood and metal. In another embodiment, the case and/or drawers are made from a combination of metal and plastic. In yet another embodiment, the case and/or drawers are made from a combination of metal, wood, and plastic. For example, it may be desirable that the cabinet top and/or drawer faces are made from wood to improve the aesthetic appeal of the lockable cabinet. In yet other examples, portions of the cabinet are made from plastic to lower the weight of the cabinet, to improve tactile feel of the cabinet, to lower cost of the cabinet, or to improve the aesthetic appeal.

In illustrative embodiment, the lock box is made of metal. In one embodiment, each of the sides of the lock box, which are not openings, are made of metal. In another embodiment, the lock box is made partially of a plastic insert. For example, the lock box may be made from a rigid thermoset that enables the lock box to include features that would be difficult to manufacture using metal. In particular, the lock box may include lips, tabs, and texturing that enhances the manufacturability or value of the overall cabinet.

Figure 2A:
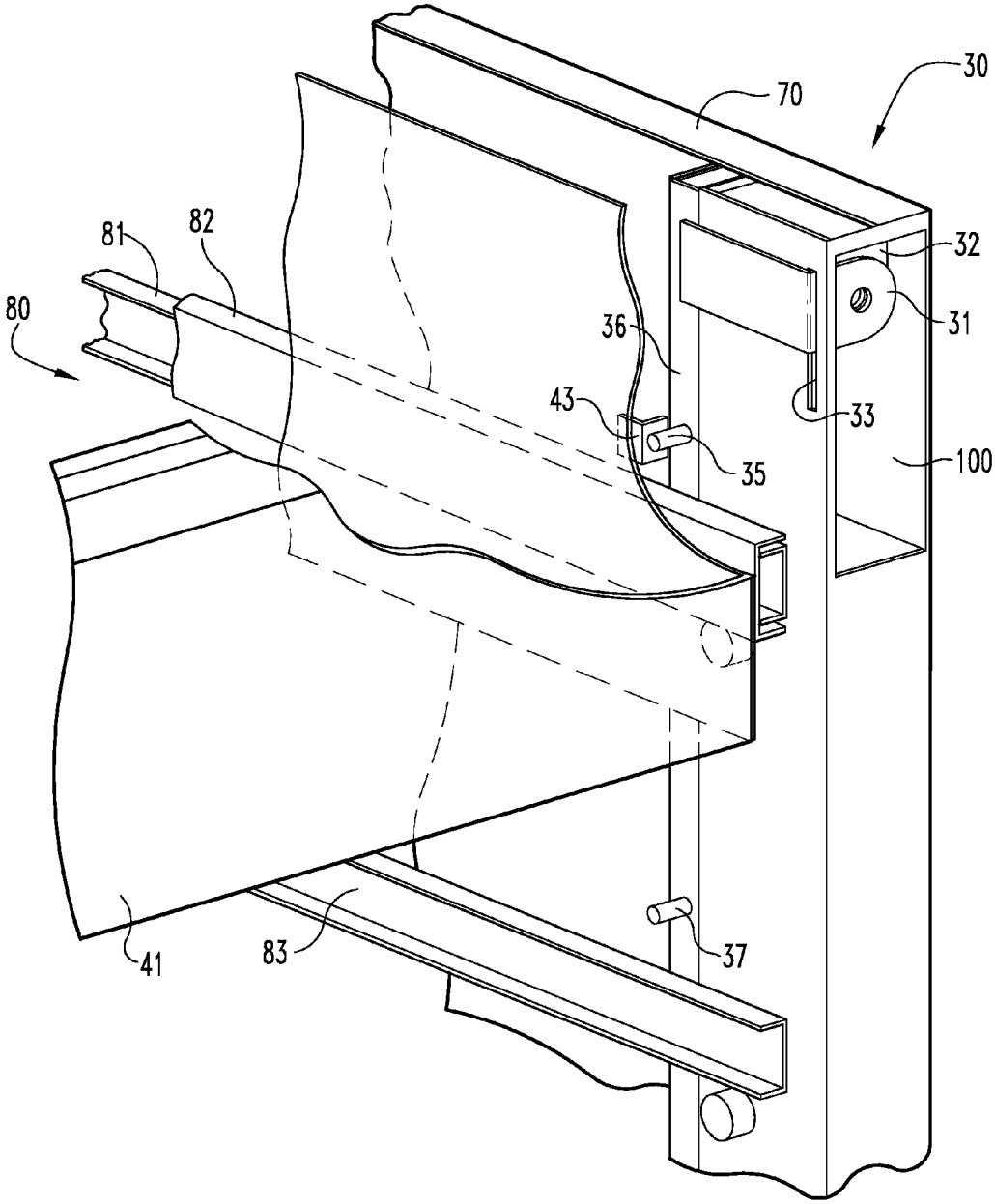
FIG. 2(A-B) are enlarged, fragmentary front broken away views of the lockable cabinet of FIG. 1 showing a side panel, a drawer, a drawer slide mechanism and a locking mechanism in a locked position (FIG. 2A) and an unlocked position (FIG. 2B)

Referring now to FIG. 2A, shown is an enlarged, fragmentary front broken away view of the lockable cabinet of FIG. 1 showing a side panel 70, a drawer 41, a drawer slide assembly 80 and locking mechanism 30 in a locked position. The locked position is established by aligning a movable eyelet 31 with a stationary or static eyelet 32. Movable eyelet 31 is operably connected to a support bar 36 (e.g. a vertically movable rigid L-shaped locking bar). In the locked position, a drawer stop, e.g., a locking pin 35, is positioned to impede movement of drawer 41. In this case, a tab or catch 43, shown in phantom, is welded or otherwise affixed to the outer surface of the right side wall of drawer 41, above a drawer slide 80, in a position behind locking pin 35 such that the locking pin blocks the path of catch 43 and thereby prevents it and thus the drawer from moving forward if an attempt to open drawer 41 is made. In particular, the locking pin and catch cooperate to prevent the drawer from sliding via drawer slide 80, which is configured as a U-shaped channel 82 fixedly mounted on the drawer side wall and a U-shaped channel 81 fixedly mounted to the case of the cabinet. As those skilled in the art will appreciate from FIGS. 2A and 2B, channel 81 is horizontally slidably received within channel 82. A roller may be provided below the front end of channel 81, as illustrated, to maintain a gap between the bottom flanges of channels 81 and 82 and thereby minimize friction during operation of the drawer slide. That is, the roller supports channel 82 and rotates as the channel moves longitudinally. An additional roller or rollers (not shown) may be provided to similarly minimize friction between channel 81 and the rear portion of channel 82. A second cabinet slide part 83 is shown with a second slide drawer stop 37 so that a representative distance between the parts can be appreciated when locking mechanism 30 is in a locked position. In illustrative embodiments, the locking mechanism is a ganging locking mechanism capable of a impeding the opening of multiple drawers simultaneously. The ganging locking mechanism, or gang lock, enables all drawers, e.g., from two to ten or more drawers, to be locked and unlocked by using a single lock attached to a single hasp. In one embodiment, the gang lock permits simultaneous unlocking and locking of drawers in a vertical stack. In another embodiment, the gang lock permits simultaneous unlocking and locking of drawers in a horizontal row.

Figure 2B:
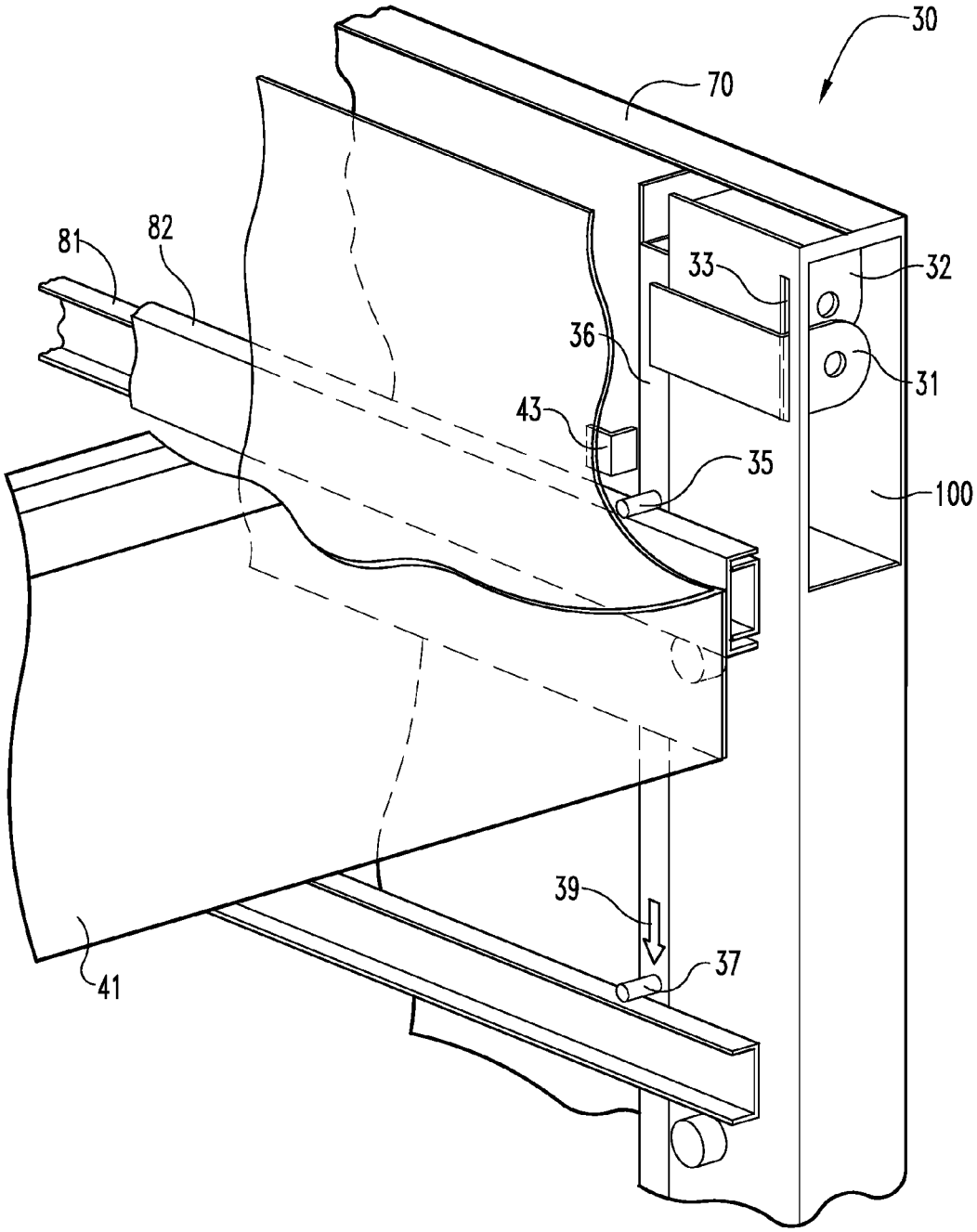

FIG. 2B shows the same enlarged, fragmentary front broken away view of the lockable cabinet of FIG. 2A, showing locking mechanism 30 in an unlocked position. The unlocked position includes movable eyelet 31 and static eyelet 32 positioned in an unaligned manner so that they could not receive a lock. While shown as eyelets, any hasp configured to receive an external or captive lock can be used in place of the shown eyelets. For example, tabs, bars, and loops can be configured in various manners to create a structure capable of receiving the lock and preventing unlocking of the gang lock without unlocking of the lock. In the case of the eyelets, the removal of a lock enables support bar 36 to move in direction of arrow 39. Movement of support bar 36 changes the position of drawer stop 35 so that tab 43 is no longer on an impact path with drawer stop during an attempt to open drawer 41. Movement of movable eyelet 31 in slot 33 accompanies movement of support bar 36. Accordingly, drawer 41 could be opened without an impact between tab 43 and drawer stop 35.

Figure 3:
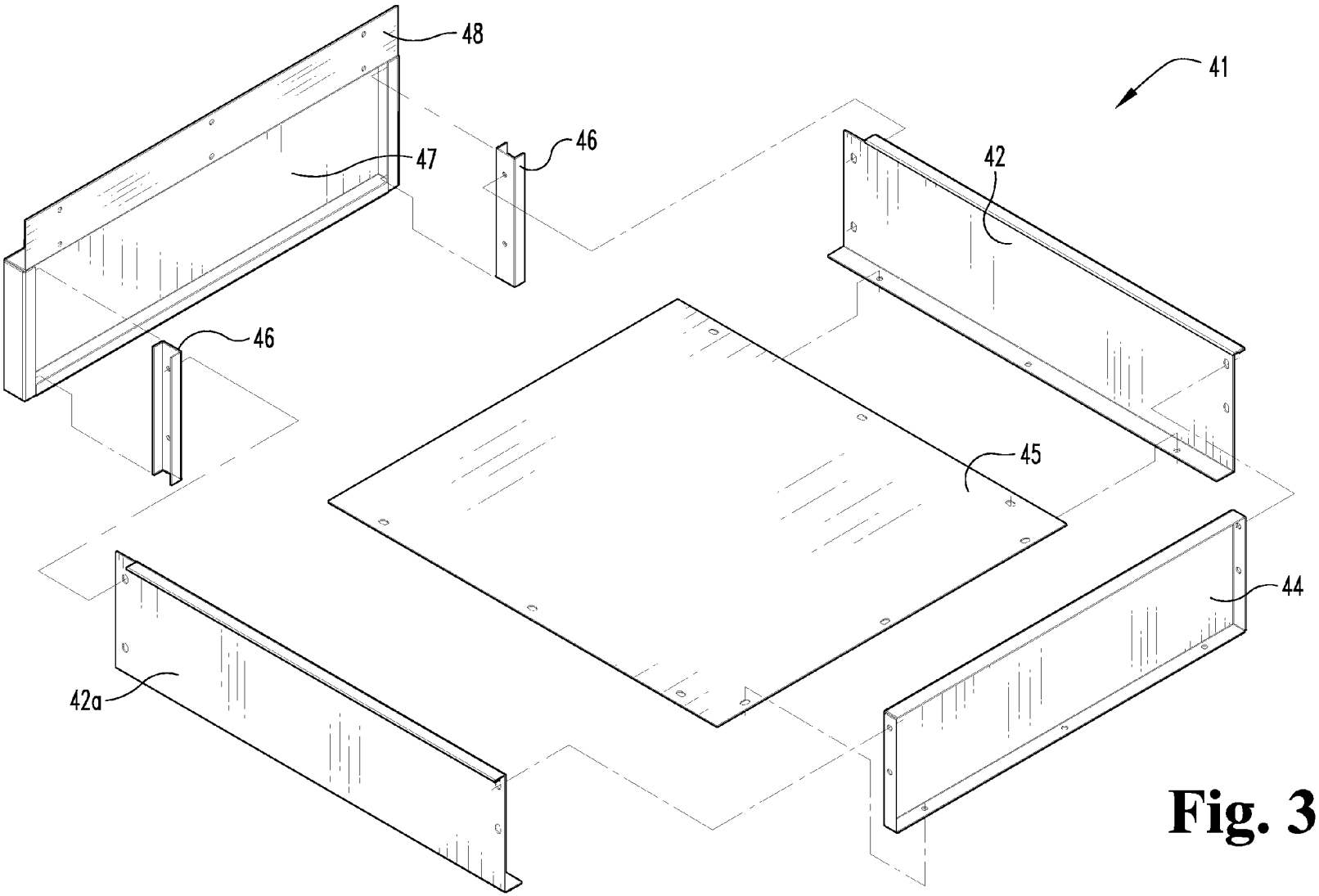
FIG. 3 is an exploded perspective view of an embodiment of a drawer with exemplary additional detail.

Referring now to FIG. 3, shown is an exploded perspective view of an embodiment of a drawer showing a first drawer side panel 42, a second drawer side panel 42*a*, a back drawer side panel 44, a bottom drawer panel 45, a front drawer side panel 47, and assembly brackets 46. One aspect of the present invention is that the secured cabinet is configured so as to maintain a clean profile and perimeter without protrusions.

Figure 4:
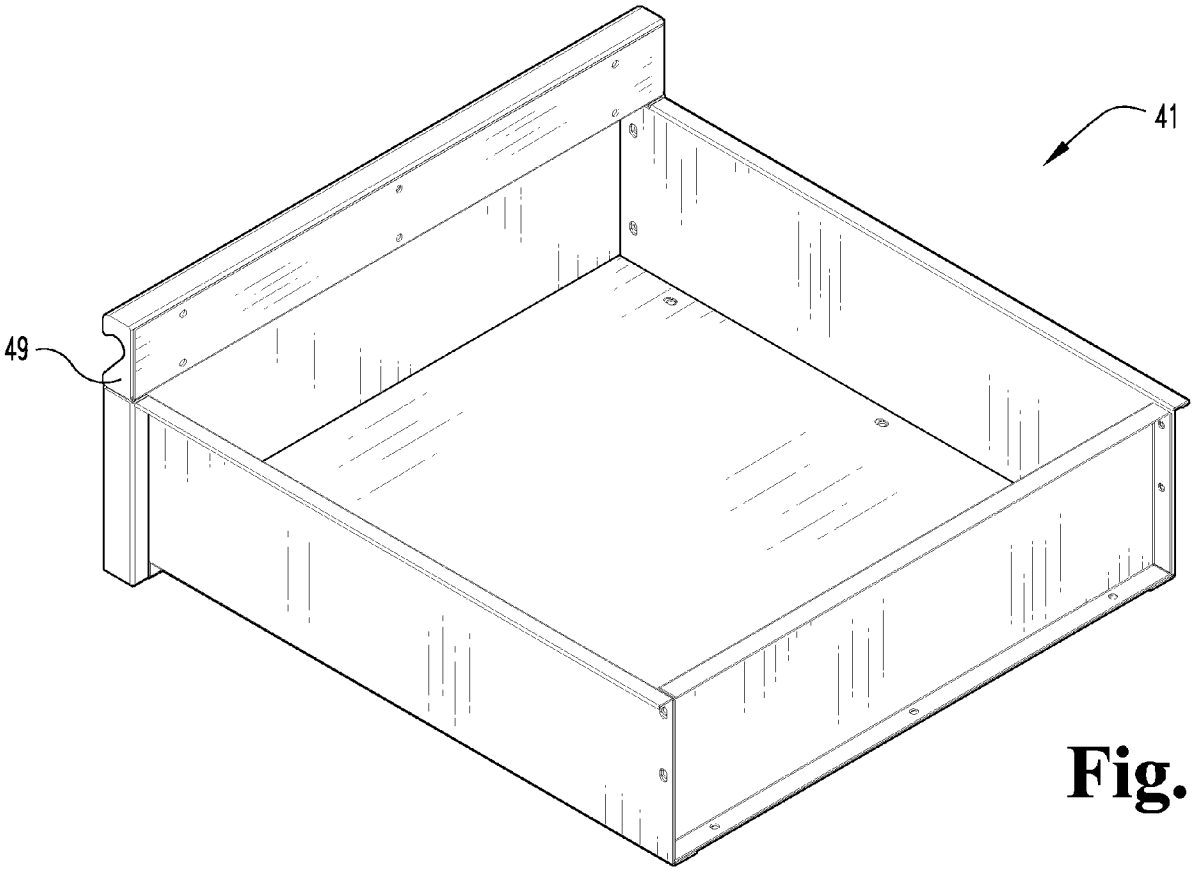
FIG. 4 is a exploded perspective view of the drawer of FIG. 3.

Drawer 41 is thus configured to maintain the clean profile and perimeter. Accordingly, front drawer side panel 47 is shown with a flange 48 adapted to receive a handle 49 (see FIG. 4) that does not protrude from the cabinet. FIG. 4 shows drawer 41 with handle 49 operably connected to flange 48 to maintain desired perimeter and profile.

Figure 5:
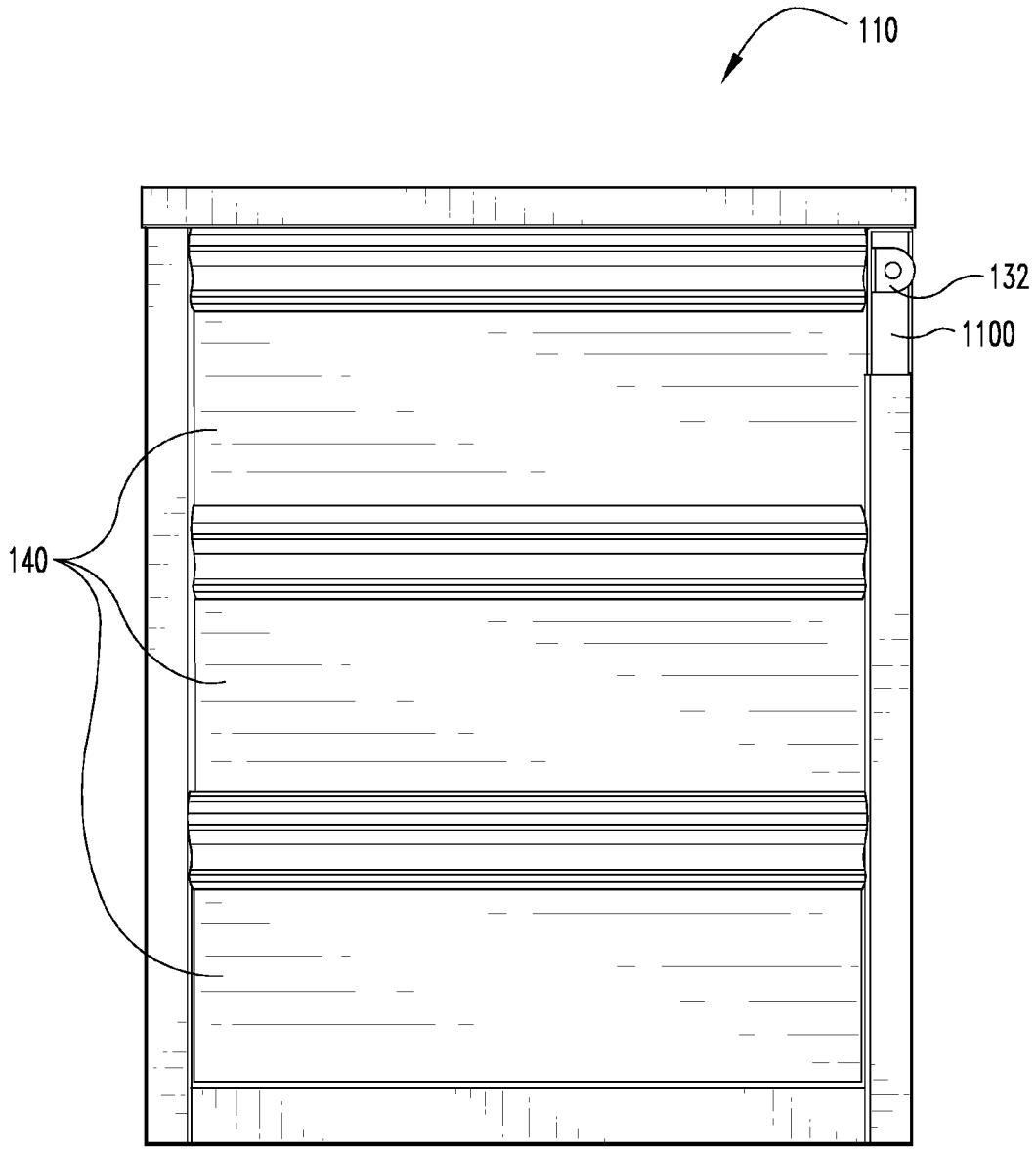
FIG. 5 is a front elevation view showing of an embodiment of a lockable cabinet showing a rectangular perimeter free of protrusions.
Figure 6:
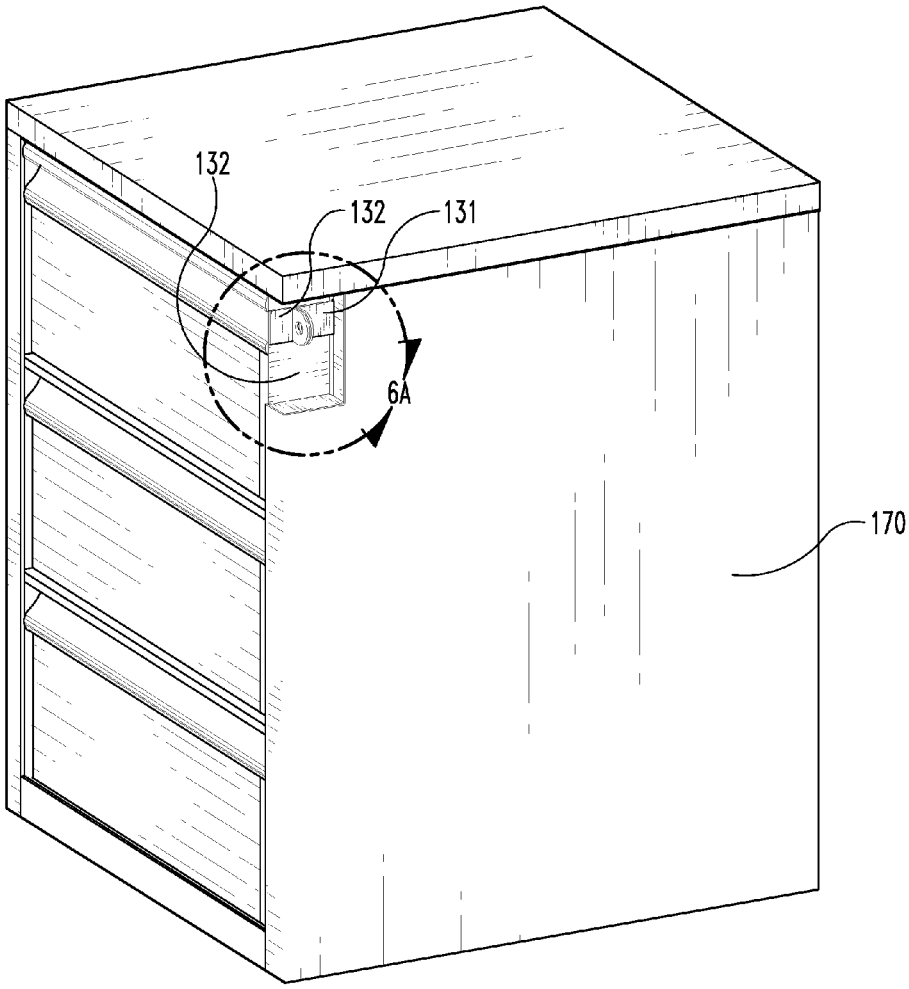
FIG. 6 is a right side perspective view of the lockable cabinet of FIG. 5 showing a portion of the locking mechanism within a lock box, further showing a profile free of protrusions.
Figure 6A:
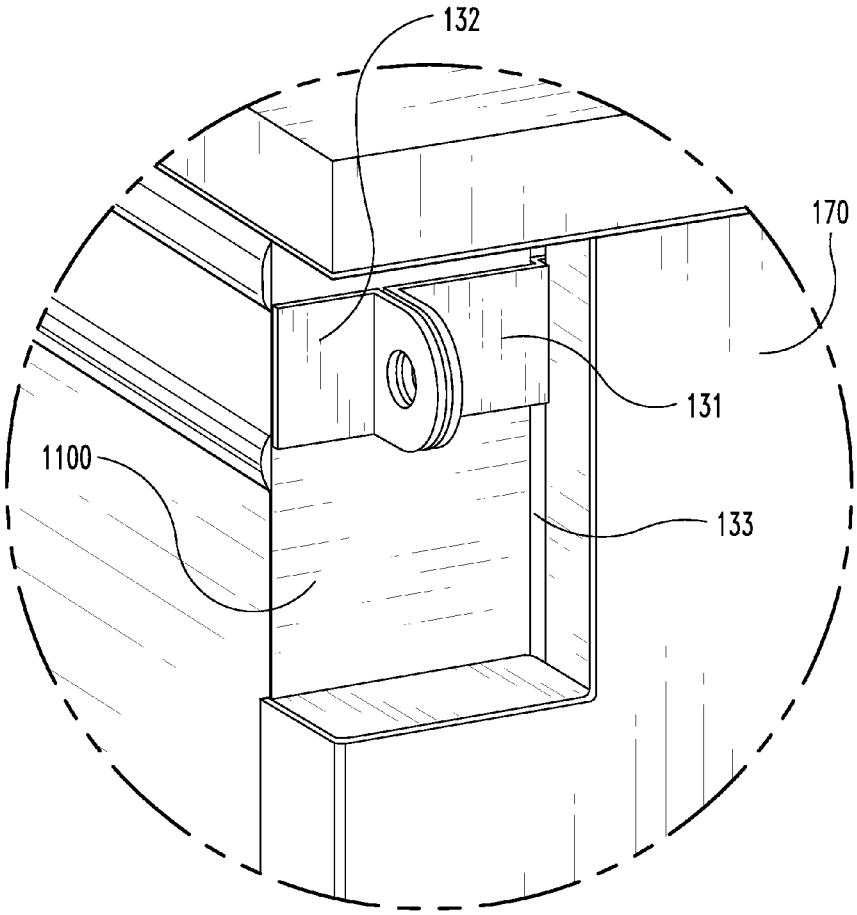
FIG. 6A is an enlarged, fragmentary front elevational view of the lock box showing the locking mechanism in the locked position.

Referring now to FIG. 5, shown is a front elevation view showing of an embodiment of a lockable cabinet 110 showing a rectangular perimeter free of protrusions. In this embodiment, lockable cabinet 110 includes three drawers 140. A lock box 1100 is configured so that a static eyelet 132 does not protrude from the perimeter of the lockable cabinet and sufficient room is provided for use of a lock without the lock protruding from the perimeter of the lockable cabinet. FIG. 6 shows a right side perspective view of the lockable cabinet of FIG. 5 showing a static eyelet 132 and a movable eyelet 131 positioned within lock box 1100 so that neither static eyelet 132 or movable eyelet 131 protrude from the profile or perimeter of secured cabinet 110. Lock box 1100 is formed from a cutout of a side panel 170. FIG. 6A shows an enlarged, fragmentary front elevational view of the lock box showing the locking mechanism in the locked position. The lockable cabinet 110 includes side panel containing lock box 1100. Lock box 1100 is a six-sided, preferably rectangular, box having two sides configured as openings sufficiently large to pass lock from a first position outside the lock box to a second position within the lock box. Furthermore, lock box 1100 includes a slot 133 along one side that allows movable eyelet 131 to move from a locked position adjacent to static eyelet 132 to an unlocked position.

Figure 7A:
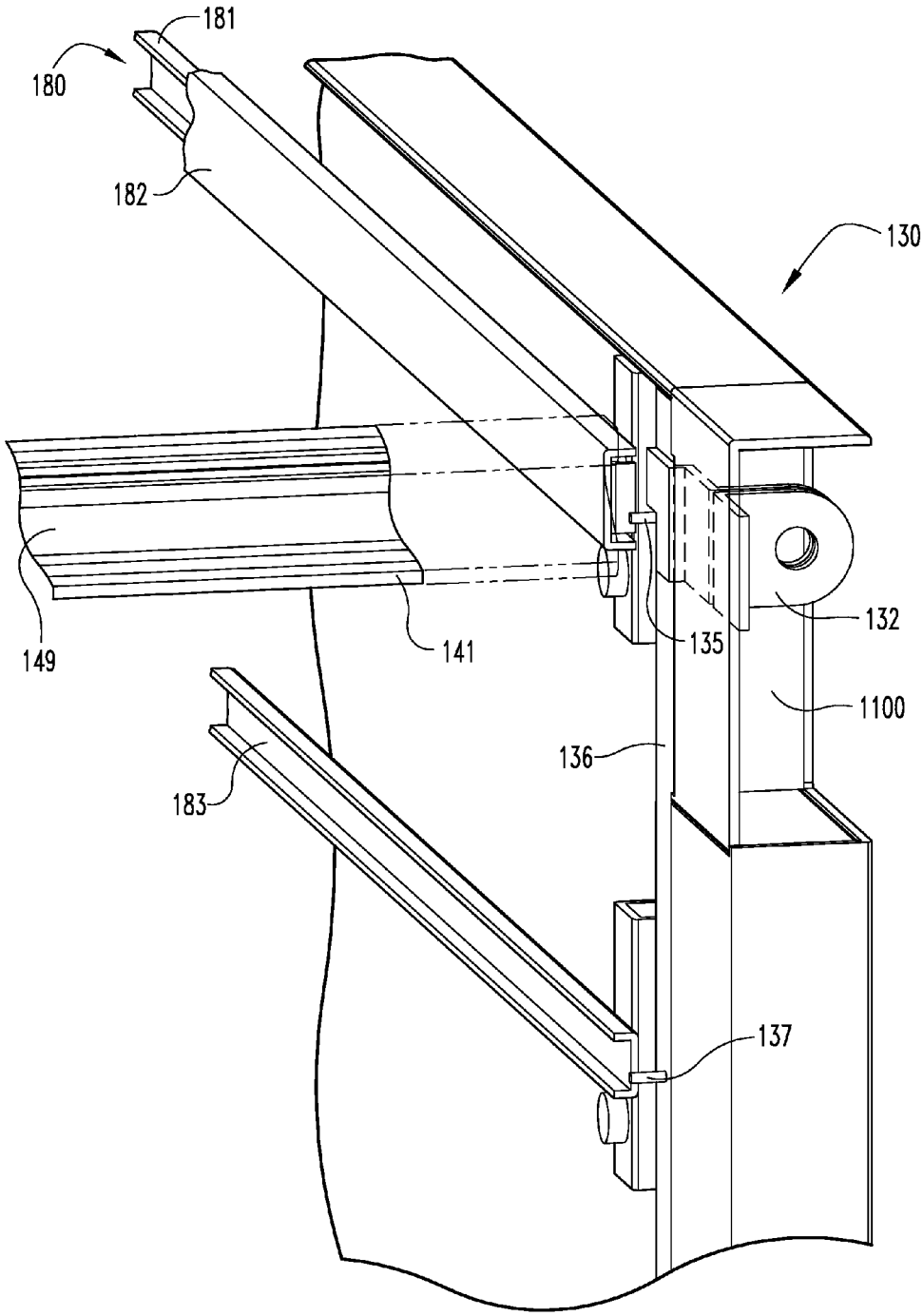
FIG. 7A is an enlarged, fragmentary perspective view of the lockable cabinet of FIG. 5 showing the locking mechanism in the locked position, further showing a drawer stop positioned to impede movement of the drawer on the drawer slide.
Figure 7B:
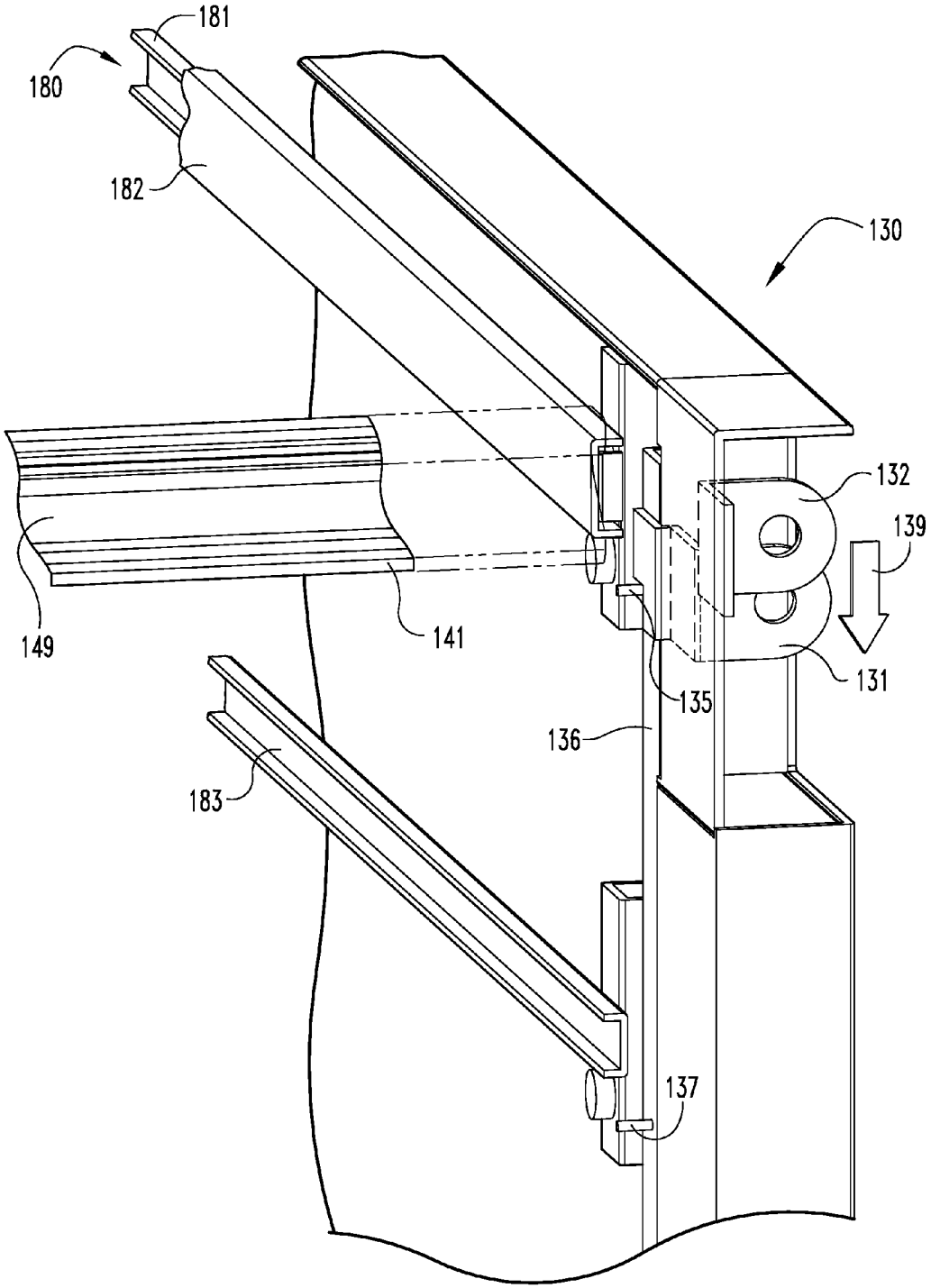
FIG. 7B is the perspective view of the lockable cabinet of FIG. 7A showing the locking mechanism in the unlocked position, further showing the drawer stop positioned to not impede movement of the drawer on the drawer slide.

FIG. 7 and FIG. 8 show exploded perspective views of lockable cabinet 110 showing a locking mechanism 130 in a locked position (FIG. 7) and an unlocked position (FIG. 8). Lockable cabinet 110 includes a drawer slide assembly 180 including a static slide component 181 and a movable slide component 182. The locking mechanism 130 includes a support bar 136 from which a first slide stop 135 and a second slide stop 137 protrude. In the locked position, slide stop 135 prevents movable slide component 182 from sliding. This prevents drawer 141 from being pulled from lockable cabinet 110 when force is applied to handle 149. Slide stop 137 correspondingly prevents movable slide component 183 from sliding. FIG. 8 shows that movable eyelet 131 moves in a direction 139 which corresponds with a movement of support bar 136 and slide stop 135. The movement of slide stop 135 allows movable slide component 182 to slide when a force is applied to drawer 141 through handle 149.

In illustrative embodiments, a lockable cabinet comprises a cabinet having a case, a drawer movably connected to the case by a drawer slide, a lock box, and a locking mechanism, the locking mechanism comprises a drawer stop, a movable locking bar, a static hasp portion, and a movable hasp portion. In one embodiment, the drawer stop is positioned to impede movement of the drawer when the locking mechanism is in a locked position, the movable hasp portion is operably connected to the movable locking bar, the movable locking bar is operably connected to the movable hasp portion, the movable hasp portion and the static hasp portion are adapted to receive a lock when the locking mechanism is in a locked position, and the movable hasp portion and the static eyelet positioned within the lock box so as to not protrude outside the perimeter of the case. In one embodiment, the lock box is configured to contain the lock when the locking mechanism is in the locked position and the lock is passing through the static eyelet. In another embodiment, the case comprises a side panel containing the lock box. In yet another embodiment, the lockable cabinet further comprises a second drawer movably connected to the case by a second drawer slide, wherein the locking mechanism further comprises a second drawer stop position to impede movement of the second drawer when the locking mechanism is in a locked position and the drawer stop and the second drawer stop position on the movable locking bar at a distance so that each is positioned to impede movement concurrently.

In illustrative embodiments, a lockable cabinet, comprising a case, a drawer movably connected to said case by a drawer slide, a lock box; and a locking mechanism. The locking mechanism may have a movable locking bar inside the case, a drawer stop mounted on the locking bar, a stationary hasp portion, and a movable hasp portion. The drawer stop is positioned to impede movement of the drawer when the locking mechanism is in a locked position. The movable and stationary hasp portions are positioned in the lock box so as to not protrude outside the perimeter of the case. The hasps are configured to jointly receive a lock when the locking mechanism is in the locked position and the movable hasp portion extends from the lock box into the case and operably connects to the locking bar. In one embodiment, the lockable cabinet includes a lock box configured as a six-sided box having an opening in one side. In one embodiment, the opening is configured to pass the lock from a first position outside the lock box to a second position within the lock box. In another embodiment, the six-sided box has openings in two sides, the openings being configured to pass the lock from a first position outside the lock box to a second position within the lock box. In another embodiment, the lock box further includes a slot through which the movable hasp portion protrudes into the lock box but not outside the lock box. In yet another embodiment, the slot is elongated in a dimension in which the movable hasp portion is movable allowing the movable hasp portion to slide from an upper position to a lower position. In yet another embodiment, the lock box is configured so that gravity forces the movable hasp portion into the lower position when the lock is not holding the locking mechanism in the locked position.

In illustrative embodiments, a lockable cabinet comprises an enclosure comprising a first side panel, a second side panel, a bottom panel, and a top panel defining an opening, the first side panel having an exterior surface defining a first plane. A first drawer is movably attached to the enclosure through a slide assembly, wherein the first drawer is movable between an open position and a closed position, the first drawer having an exterior surface defining a frontal plane when the drawer is in the closed position. A latch system is configured to selectively retain the drawer in the closed position. The latch system comprises a static eyelet and a movable eyelet. The static eyelet attached to the enclosure and the movable eyelet attached to a locking bar. The locking bar is configured to move to a first position in which the locking bar impedes movement of the drawer along the slide assembly when the movable eyelet and the static eyelet are arranged to jointly receive a padlock. The locking bar is configured to move to a second position in which the locking bar does not impede movement of the drawer along the slide allowing the drawer to open. Furthermore, the cabinet includes a recessed lock box configured to contain the movable eyelet and the static eyelet so the eyelets do not extend substantially through the frontal plane or the first plane.

In illustrative embodiments, the lockable cabinet includes a recessed lock box configured in a manner and married to a padlock so that the recessed lock box contains the padlock when the padlock is passed through the movable eyelet and the static eyelet such that the padlock does not extend substantially through the frontal plane or the first plane. In one embodiment, the recessed lock box is configured to have an opening indented from the frontal plane. In another embodiment, the recessed lock box is configured as to be enclosed on every side except the opening indented from the frontal plane. In yet another embodiment, the recessed lock box is configured to have an opening indented from the first plane. In one embodiment, the recessed lock box is configured as to be enclosed on every side except the opening indented from the frontal plane. In another embodiment the recessed lock box is configured to have an opening indented from the frontal plane and the first plane. In yet another embodiment, the recessed lock box is configured as to be enclosed on sides except the opening indented from the frontal plane and the first plane. In still another embodiment, the lockable cabinet further comprises a second drawer, the latch system configured to selectively retain the first drawer and the second drawer in the closed position, the locking bar comprising a ganging lock configured to impede movement of the first drawer along the slide assembly and the second drawer along a second slide assembly. In another embodiment, the lockable cabinet further comprises a third drawer, the latch system configured to selectively retain the first drawer, the second drawer, and the third drawer in the closed position, the locking bar comprising a ganging lock configured to impede movement of the first drawer along the slide assembly, the second drawer along a second slide assembly, and the third drawer along a third slide assembly.

In illustrative embodiments, as shown in FIG. 1, the lockable cabinet has a hasp lock recessed behind the frontmost surface of a side panel of a chest of drawers and enclosed by an outer side wall and an upper wall. FIGS. 2A and 2B shows two positions of a vertically movable rigid L-shaped locking bar or strap with a hole therethrough for alignment with a complementary hole in a fixed rigid locking member, and FIG. 1 shows a padlock in engagement with the aligned holes in the locked position, the padlock fully recessed behind the front surface of the case. FIG. 2 also shows a vertical linking bar with transversely extending locking pins above each of two runners or drawer slides. The associated drawers each have a catch provided on a side wall thereof above the drawer slide, in a position behind the locking pin when the drawer is closed, to cooperate with the pin to prevent the opening of the drawer when the pin is in the locked position illustrated in FIG. 2A.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A lockable cabinet, comprising:

a case;

a drawer movably connected to said case by a drawer slide;

a lock box; and a locking mechanism, said locking mechanism having a movable locking bar inside said case, a drawer stop mounted on said locking bar, a stationary hasp portion, and a movable hasp portion, said drawer stop positioned to impede movement of said drawer when said locking mechanism is in a locked position, said movable and stationary hasp portions positioned in said lock box so as to not protrude outside the perimeter of said case and configured to jointly receive a lock when said locking mechanism is in the locked position, said movable hasp portion extending from said lock box into said case and operably connecting to said locking bar.

2. The lockable cabinet of claim 1, wherein the lock box is configured to contain the lock when the locking mechanism is in the locked position and the lock is passing through the stationary hasp portion.

3. The lockable cabinet of claim 1, wherein the case comprises a side panel containing said lock box.

4. The lockable cabinet of claim 1, further comprising a second drawer movably connected to said case by a second drawer slide, wherein said locking mechanism further comprises a second drawer stop positioned to impede movement of the second drawer when the locking mechanism is in the locked position, and said drawer stop and said second drawer stop are positioned on said locking bar at a distance so that each is positioned to impede movement.

5. The lockable cabinet of claim 1, wherein the lock box is a six-sided rectangular box having an opening in one side.

6. The lockable cabinet of claim 5, wherein said opening is configured to pass said lock from a first position outside said lock box to a second position within said lock box.

7. The lockable cabinet of claim 6, wherein said six-sided box has openings in two sides, said openings are configured to pass said lock from said first position outside said lock box to said second position within said lock box.

8. The lockable cabinet of claim 6, wherein said lock box further includes a slot through which said movable hasp portion protrudes into said lock box.

9. The lockable cabinet of claim 8, wherein said slot is elongated in a dimension in which said movable hasp portion is movable allowing said movable hasp portion to slide from an upper position to a lower position.

10. The lockable cabinet of claim 9, wherein said lock box is configured so that gravity can act on said movable hasp portion so as to move said movable hasp portion into said lower position when said lock is not holding said locking mechanism in said locked position.

11. A lockable cabinet, comprising:

an enclosure comprising a first side panel, a second side panel, a bottom panel, and a top panel defining an opening, said first side panel having an exterior surface defining a first plane;

a first drawer movably attached to said enclosure through a slide assembly, wherein said first drawer is movable between an open position and a closed position, said first drawer having an exterior surface defining a frontal plane when said first drawer is in said closed position; and a locking mechanism configured to selectively retain said first drawer in said closed position, said locking mechanism comprising a static eyelet and a movable eyelet, said static eyelet attached to said enclosure and said movable eyelet attached to a vertically movable rigid locking bar, wherein said locking bar is configured to move to a first position in which said locking bar impedes movement of said first drawer along said slide assembly when said movable eyelet and said static eyelet are arranged to receive a padlock, said locking bar is configured to move to a second position in which said locking bar does not impede movement of said first drawer along said slide assembly allowing said first drawer to open, and said cabinet includes a recessed lock box, wherein said recessed lock box includes a slot through which said movable eyelet is operably connected to said locking bar and said recessed lock box contains said static eyelet so that neither said movable eyelet or said static eyelet extends substantially through said frontal plane or said first plane.

12. The lockable cabinet of claim 11, wherein said recessed lock box and said padlock are configured so that said recessed lock box contains said padlock in its entirety when said padlock is passed through said movable eyelet and said static eyelet such that said padlock does not extend substantially through said frontal plane or said first plane.

13. The lockable cabinet of claim 11, wherein said recessed lock box is configured to have an opening in said frontal plane.

14. The lockable cabinet of claim 13, wherein said recessed lock box is configured to be enclosed on every side except said opening in said frontal plane and said slot.

15. The lockable cabinet of claim 11, wherein said recessed lock box is configured to have an opening in said first plane.

16. The lockable cabinet of claim 15, wherein said recessed lock box is configured to be enclosed on every side except said opening in said frontal plane and said slot.

17. The lockable cabinet of claim 11, wherein said recessed lock box is configured to have an opening in said frontal plane, said first plane, and said slot.

18. The lockable cabinet of claim 17, wherein said recessed lock box is configured to be enclosed on sides except said opening in said frontal plane, said first plane, and said slot.

19. The lockable cabinet of claim 11, wherein said lockable cabinet further comprises a second drawer, said locking mechanism configured to selectively retain said first drawer and said second drawer in said closed position, said locking bar comprising a ganging lock configured to impede movement of said first drawer along said slide assembly and said second drawer along a second slide assembly.

20. The lockable cabinet of claim 11, wherein said lockable cabinet further comprises a third drawer, said locking mechanism configured to selectively retain said first drawer, said second drawer, and said third drawer in said closed position, said locking bar comprising a ganging lock configured to impede movement of said first drawer along said slide assembly, said second drawer along a second slide assembly, and said third drawer along a third slide assembly.

* * * * *